US012557871B2

(12) United States Patent
Huangfu et al.

(10) Patent No.: US 12,557,871 B2
(45) Date of Patent: Feb. 24, 2026

(54) REINFORCED KNIT CHANNEL FOR AN ARTICLE OF FOOTWEAR

(71) Applicant: NIKE, Inc., Beaverton, OR (US)

(72) Inventors: Chaokun Huangfu, Portland, OR (US); Seth M. Wiberg, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/583,155

(22) Filed: Feb. 21, 2024

(65) Prior Publication Data

US 2024/0285031 A1 Aug. 29, 2024

Related U.S. Application Data

(60) Provisional application No. 63/447,992, filed on Feb. 24, 2023.

(51) Int. Cl.

| | |
|---|---|
| ***A43B 1/04*** | (2022.01) |
| ***A43B 23/02*** | (2006.01) |
| ***D04B 1/10*** | (2006.01) |

(52) U.S. Cl.

CPC ..... *A43B 1/04* (2013.01); *A43B 23/025* (2013.01); *D04B 1/10* (2013.01)

(58) Field of Classification Search

CPC ..... A43B 1/04; A43B 23/025

See application file for complete search history.

(56) References Cited

U.S. PATENT DOCUMENTS 4,040,275 A * 8/1977 Castello ..... D04B 1/126 66/196
8,959,959 B1 * 2/2015 Podhajny ..... A43B 23/042 36/47
2005/0229641 A1 * 10/2005 Okamoto ..... D04B 1/24 66/64
2009/0056384 A1 * 3/2009 Sayer ..... D04B 7/06 66/171
2012/0233882 A1 * 9/2012 Huffa ..... A43B 23/0205 36/45
2014/0196311 A1 * 7/2014 Follet ..... D04B 21/20 428/174

(Continued)

FOREIGN PATENT DOCUMENTS

EP 3113640 B1 2/2019

OTHER PUBLICATIONS

International Search Report and Written Opinion received for PCT Patent Application No. PCT/US2024/017096, mailed on May 17, 2024, 12 pages.

*Primary Examiner* — Megan E Lynch

(74) *Attorney, Agent, or Firm* — Shook, Hardy & Bacon L.L.P.

(57) ABSTRACT

Aspects herein are directed to a reinforced knit channel for an upper configured to receive a lace. The knit channel includes a first knit layer and a second knit layer that at least partially overlaps the first knit layer and is interlooped with the first knit layer at a first interlooped area and a second interlooped area. A channel region is present between the first and second interlooped areas. A first portion of a tensile strand is integrated into the first knit layer in the channel region, and a second portion of the tensile strand extends over a surface of the first knit layer within the channel region. The tensile strand helps to reinforce openings into the channel region.

21 Claims, 6 Drawing Sheets

(56) References Cited

U.S. PATENT DOCUMENTS

| | | | | |
|---|---|---|---|---|
| 2014/0245633 | A1* | 9/2014 | Podhajny | A43D 8/00 66/170 |
| 2014/0245634 | A1* | 9/2014 | Podhajny | D04B 1/22 66/170 |
| 2015/0059210 | A1* | 3/2015 | Droege | A43B 1/04 12/142 R |
| 2015/0216254 | A1* | 8/2015 | Podhajny | A43B 1/04 66/170 |
| 2015/0250256 | A1* | 9/2015 | Podhajny | A43B 23/042 36/83 |
| 2016/0058099 | A1* | 3/2016 | Panian | D04B 1/123 66/170 |
| 2017/0245582 | A1* | 8/2017 | Green | A43B 1/04 |
| 2018/0110283 | A1* | 4/2018 | Brinkman | A43B 1/028 |
| 2019/0037966 | A1* | 2/2019 | Aceves Tinajero | D04B 1/24 |
| 2022/0053883 | A1* | 2/2022 | Henrichot | D04B 1/123 |

* cited by examiner

REINFORCED KNIT CHANNEL FOR AN ARTICLE OF FOOTWEAR

CROSS-REFERENCE TO RELATED APPLICATIONS

This application claims the benefit of U.S. Provisional Patent Application No. 63/447,992, filed on Feb. 24, 2023, the entirety of which is hereby incorporated by reference.

TECHNICAL FIELD

Aspects herein are directed to a reinforced knit channel for an article of footwear.

BACKGROUND

Knit channels, as well as loop structures, may be used in uppers for articles of footwear to, for example, retain a lace where the lace may be used to help secure the upper to a foot of a wearer. In this example, the lace may exert tension on the knit structures that form the channel. In some instances, this may cause the knit structures that form the channel to weaken, stretch, and/or tear over time.

BRIEF DESCRIPTION OF THE DRAWINGS

Examples of aspects herein are described in detail below with reference to the attached drawing figures, wherein.

DETAILED DESCRIPTION

Figure 1:
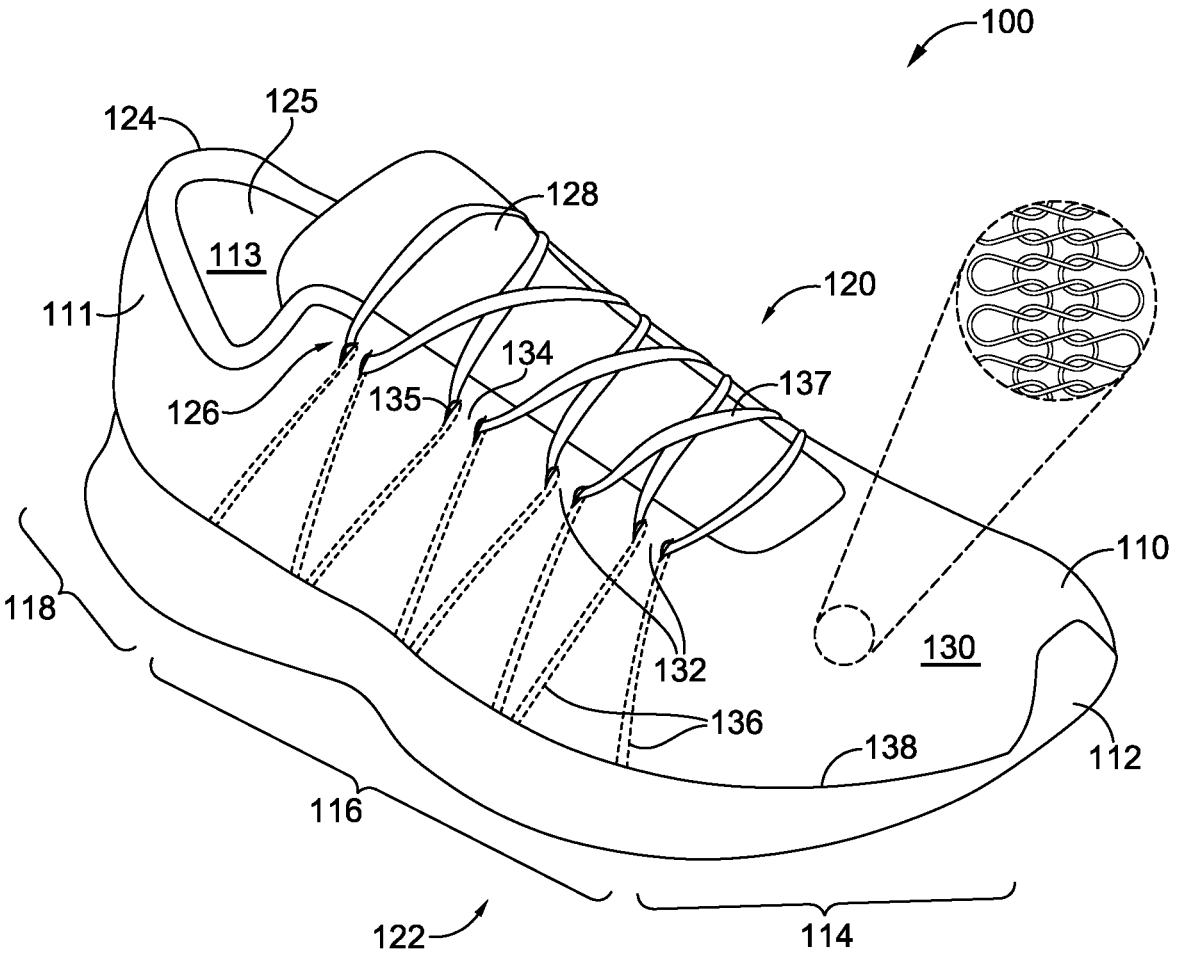
FIG. 1 illustrates a side perspective view of an example article of footwear with a knit upper and reinforced knit channels in accordance with aspects herein.

Knit channels, as well as loop structures, may be used in uppers for articles of footwear to, for example, retain a lace where the lace may be used to help secure the upper to a foot of a wearer. In this example, the lace may exert tension on the knit structures that form the channel. In some instances, this may cause the knit structures that form the channel to weaken, stretch, and/or tear over time.

At a high level, aspects herein are directed to an article of footwear that includes a knit upper having knit channels that are reinforced with tensile strands. The knit channels may be used, for example, to retain a lace that can be used to help secure the upper to a foot of a wearer. In example aspects, the knit channels are formed of a knit structure that includes a first knit layer and a second knit layer that at least partially overlaps the first knit layer. The second knit layer is interlooped with the first knit layer at a first interlooped area and a second interlooped area that is spaced apart from the first interlooped area. Between the first interlooped area and the second interlooped area, the second knit layer is freely separable from (i.e., not connected to) the first knit layer to form a channel region. The second knit layer includes a first free edge that forms a first opening of the channel region and a second free edge that forms a second opening of the channel region such that the channel extends between the first and second openings.

A tensile strand, which may include a high-tenacity strand and/or a strand that has a higher resistance to stretch than yarns forming one or more of the first knit layer and the second knit layer, is used to reinforce the channel. In one example, a first portion of the tensile strand may be integrated into the first knit layer in the channel region. In example aspects, the tensile strand may be integrated into the first knit layer through an inlay process or a mock inlay process. At a border between the first interlooped area and the channel region, the first portion of the tensile strand transitions to a second portion that extends over an exterior surface of the first knit layer in the channel region. In certain aspects, the second portion of the tensile strand is freely separable from both of the first knit layer and the second knit layer. In example aspects, the tensile strand is positioned such that the first portion of the tensile strand is interior to the first free edge of the second knit layer, and the second portion of the tensile strand is aligned with the first free edge. In example aspects, the tensile strand may further include a third portion that is integrated into the first knit layer at a location that is interior to the second free edge of the second knit layer, and a fourth portion that is aligned with the second free edge. In example aspects, the fourth portion is freely separable from both the first knit layer and the second knit layer. In this example, both of the openings to the channel region are reinforced with the tensile strand. In example aspects, the upper may include multiple channel regions that may be generally located adjacent to a throat region of the upper.

In use, a lace may extend through the channel region such that the lace is located between the first knit layer and the second knit layer. The lace further extends between the second portion of the tensile strand and a part of the first knit layer that includes the first portion of the tensile strand such that the second portion of the tensile strand is located exterior to the lace and the first portion of the tensile strand is located interior to the lace. When tension or a force is applied to the lace, the force is distributed not only to the first and second knit layers but also to the first and second portions of the tensile strand. Because the tensile strand may comprise a high-tenacity material and/or may have a greater resistance to stretch than the yarns used to form the first and second knit layers, the tensile strand helps to reinforce the knit channel. This may increase the useable life of an upper that includes the knit channel structure by reducing tearing and/or stretching of the knit channel.

As used herein, an article of footwear generally includes a sole structure secured to an upper. The article of footwear described herein may comprise a running shoe, a baseball shoe, a basketball shoe, a cycling shoe, a football shoe, a tennis shoe, a soccer shoe, a training shoe, a walking shoe, a hiking shoe, and the like. The concepts described herein may also be applied to other footwear types that are considered non-athletic, such as dress shoes, loafers, sandals, and work boots. As used herein, the article of footwear may be divided into different general regions. A forefoot region generally includes portions of the article of footwear that correspond to the toes and joints connecting the metatarsals with the phalanges. A midfoot region generally includes portions of the article of footwear corresponding with an arch area and an instep area of the foot. A heel region generally corresponds with rear portions of the foot, including the calcaneus bone. The article of footwear described herein may include a lateral side, which corresponds with an outside area of the foot (i.e., the surface that faces away from the other foot), and a medial side, which corresponds with an inside area of the foot (i.e., the surface that faces toward the other foot). The different regions and sides described above are intended to represent general areas of footwear to aid in the following discussion and are not intended to demarcate precise areas. The different regions and sides may be applied to the article of footwear as a whole, to the upper, and to the sole structure.

The term "exterior surface" as used herein means a surface of the upper or article of footwear that faces the external environment. In some aspects, the exterior surface may mean the outermost surface of the upper or article of footwear. The term "interior surface" as used herein means a surface of the upper or article of footwear that faces a void for receiving the wearer's foot. In some aspects, the interior surface may mean the innermost surface of the upper or article of footwear. The term "interior to," when referring to one object's relation to another object, means closer to the void for receiving the wearer's foot, and the term "exterior to," when referring to one object's relation to another object, means closer to an external environment.

The term "knit layer" refers to a textile piece that is formed from at least one yarn that is manipulated (e.g., with a knitting machine) to form a plurality of intermeshed loops (also known as interlooping) that define courses and wales. The term "course," as used herein, refers to a predominantly horizontal row of knit loops (in an upright textile, as the textile piece is knit on the knitting machine) that is produced by adjacent needles during the same knitting cycle. The course may comprise one or more stitch types, such as a knit stitch, a missed stitch, a tuck stitch, a transfer stitch, a rib stitch, and the like, as these terms are known in the art of knitting. The term "wale," as used herein, is a predominantly vertical column of intermeshed or interlooped knit loops, generally produced by the same needle at successive (but not necessarily all) courses or knitting cycles.

The term "integrally knit," as used herein, may mean a knit component having a yarn from one or more knit courses in a first area or layer being interlooped with one or more knit courses of another area or layer. The interlooping may be through a simple knit stitch, a tuck stitch, a held stitch, a float or miss stitch, and the like. In this way, areas that are integrally knit together have a seamless transition.

The term "double knit construction" as used herein refers to a knit construction that is generally formed on at least two needle beds of a knitting machine (i.e., a multi-bed construction). Such multi-bed knit construction may be characterized by two opposing faces of knit loops and/or tucks, e.g., one face of loops formed on a first needle bed, and a second face of loops formed on a second needle bed. In example aspects, the two faces may be joined by yarns that interloop with yarns in both the first face and the second face of the double knit construction. Common double knit constructions include double jersey, rib, interlock, cardigan, other "double-bed" knit structures initially formed on at least two needle beds, and other knit structures having two opposing faces of knit loops or tucks, including full-gauge and less-than-full gauge variations of those structures. The term "single knit construction" as used herein refers to a knit construction generally formed on a single needle bed (i.e., a single-bed construction). Common single knit constructions include single jersey.

Unless indicated otherwise, all measurements provided herein are taken when the upper and/or article of footwear is at standard ambient temperature and pressure (298.15 K and 100 kPa) and is in a resting (non-tensioned) state.

FIG. 1 depicts an example article of footwear 100 having an upper 110 and a sole structure 112 secured to the upper 110. The upper 110 includes an exterior surface 111 and an interior surface 113. The article of footwear 100 is shown in the form of an athletic shoe, but other types of shoes (e.g., sandals, leisure shoes, and the like) are contemplated herein. The article of footwear 100 includes a forefoot region 114, midfoot region 116, a heel region 118, a medial side 120, and a lateral side 122. The article of footwear 100 includes an ankle collar 124 having an opening 125 for receiving a wearer's foot, a throat area 126, and a tongue 128. In example aspects, the tongue 128 may be integrally formed with the upper 110, or the tongue 128 may comprise a separate element that is secured to the upper 110 in, for example, a post-knitting manufacturing step.

In example aspects, the upper 110 may be formed from a first knit layer 130 and a second knit layer 132. In example aspects, the second knit layer 132 may be limited to one or more discrete areas, such that remaining portions of the upper 110 may be formed solely from the first knit layer 130. In example aspects, the first knit layer 130 may comprise a double knit construction, although aspects herein contemplate that the first knit layer 130 may comprise a single knit construction. In example aspects, the second knit layer 132 may comprise a single knit construction, although aspects herein contemplate that the second knit layer 132 may comprise a double knit construction. In example aspects, the first knit layer 130 may form at least a portion of the upper 110 and, in some examples, substantially the entirety of the upper 110 as shown. In example aspects, the second knit layer 132 may be primarily located in the throat area 126 where the second knit layer 132, in combination with the first knit layer 130, forms channel regions 134 (which may also just be referred to as channels) through which a lace 137 may be threaded, as further described below. Although shown primarily in the throat area 126, aspects herein contemplate that the second knit layer 132 may be located in other areas of the upper 110 to form additional channel regions 134.

The first knit layer 130 and the second knit layer 132 may be formed as an integral one-piece element during a knitting process, such as a weft knitting process (e.g., with a flat knitting machine with one, two, or more needle beds, or with a circular knitting machine), a warp knitting process, or any other suitable knitting process. That is, a knitting process on a knitting machine may substantially form the knit structure of the first knit layer 130 and the second knit layer 132 without the need for substantive post-knitting processes or steps. Alternatively, the first knit layer 130 and the second knit layer 132 may be formed separately as distinct integral one-piece elements, and then the respective elements may be attached.

Forming the upper 110 from knit layers such as the first knit layer 130 and the second knit layer 132 may provide advantages including, but not limited to, a particular degree of elasticity (for example, as expressed in terms of Young's modulus), breathability, bendability, strength, moisture absorption, weight, abrasion resistance, melting temperature, and/or a combination thereof. These characteristics may be accomplished by selecting a particular knit structure (e.g., a single knit construction, a double knit construction, and the like), by varying the size and tension of the knit structure, by using one or more yarns formed of a particular material (e.g., a polyester material, a thermoplastic or fusible material, a relatively inelastic material, or a relatively elastic material such as elasticated yarns), by selecting yarns of a particular size (e.g., denier), and/or a combination thereof. In example aspects, one or more yarns forming the upper may incorporate a fusible or thermoplastic polymer material, which softens or melts when heated and returns to a solid state when cooled. More particularly, the thermoplastic polymer material transitions from a solid state to a softened or liquid state when subjected to sufficient heat, and then the thermoplastic polymer material transitions from the softened or liquid state to the solid state when sufficiently cooled. The thermoplastic polymer material, which may be thermoplastic polyurethane, fuses or bonds with the knit structure and stabilizes and minimizes stretch the area in which it is incorporated. Forming the upper 110 from knit layers such as the first knit layer 130 and the second knit layer 132 may also provide desirable aesthetic characteristics by incorporating yarns having different colors, textures, or other visual properties arranged in a particular pattern. The yarns themselves and/or the knit structure formed by one or more of the yarns may be varied at different locations such that the upper 110 may have two or more portions with different properties (e.g., a portion forming the throat area 126 of the upper 110 may be relatively elastic while another portion may be relatively inelastic).

The upper 110 further includes one or more tensile strands 136, which are shown in dotted line to indicate that they are generally integrated into the first knit layer 130 except, in some examples, in the channel regions 134 as indicated by reference numeral 135, where at least a portion of the tensile strands 136 are freely separable from both the first knit layer 130 and the second knit layer 132. The integration of the tensile strands 136 into the first knit layer 130 may be through an inlaying process or a mock inlay process, as described below with respect to FIGS. 5-7. Although integrated into the first knit layer 130, aspects herein contemplate that the tensile strands 136 may be at least partially visible when viewing the article of footwear 100. For example, the tensile strands 136 may have a contrasting color to the yarns used to form the first knit layer 130 and, as such, may be visible through the knit loops that form the first knit layer 130.

The tensile strands 136 may have the configuration of a multi-filament yarn, a filament (e.g., a mono-filament yarn), thread, rope, webbing, cable, or chain, for example. The tensile strands 136 may comprise a material having a property to increase the strength of the first knit layer 130 in areas with the tensile strands 136. For example, the tensile strands 136 may comprise a yarn having a high tenacity, such as a tenacity greater than 5 grams/denier. In some aspects, the tenacity of the tensile strands 136 may be greater than other yarn(s) of the first knit layer 130 and/or the second knit layer 132. In one example, the tensile strands 136 are formed by a high-tenacity nylon yarn. Further, in some examples the tensile strands 136 may exhibit greater stretch resistance than the rest of the first knit layer 130 and/or the second knit layer 132, and may be formed from a variety of engineered filaments that are utilized for high tensile strength applications, including glass, aramids (e.g., para-aramid and meta-aramid), ultra-high molecular weight polyethylene, and liquid crystal polymer.

The upper may have lines or axes containment corresponding to areas that, when provided with reinforcement, create a desired fit or containment of the upper 110 around the foot of a wearer when the article of footwear 100 is worn. The tensile strands 136 may extend along one or more lines of containment and provide additional strength and structure to the underlying knit structure of the first knit layer 130 due to the material composition and/or manner of integration of the tensile strands 136. In this way, the tensile strands 136 may be positioned in areas of the first knit layer 130 corresponding to particular lines of containment desired or suitable for the article of footwear 100. In the example shown in FIG. 1, the tensile strands 136 are shown extending from a biteline 138 (i.e., the area where the upper 110 meets the sole structure 112) to, and through, the channel regions 134 to provide additional containment on the medial side 120 and the lateral side 122 of the article of footwear 100. This is just one example pattern, and other locations for the tensile strands 136 are contemplated herein. As described further below, the tensile strands 136 may be used to reinforce the channel regions 134.

Figure 2:
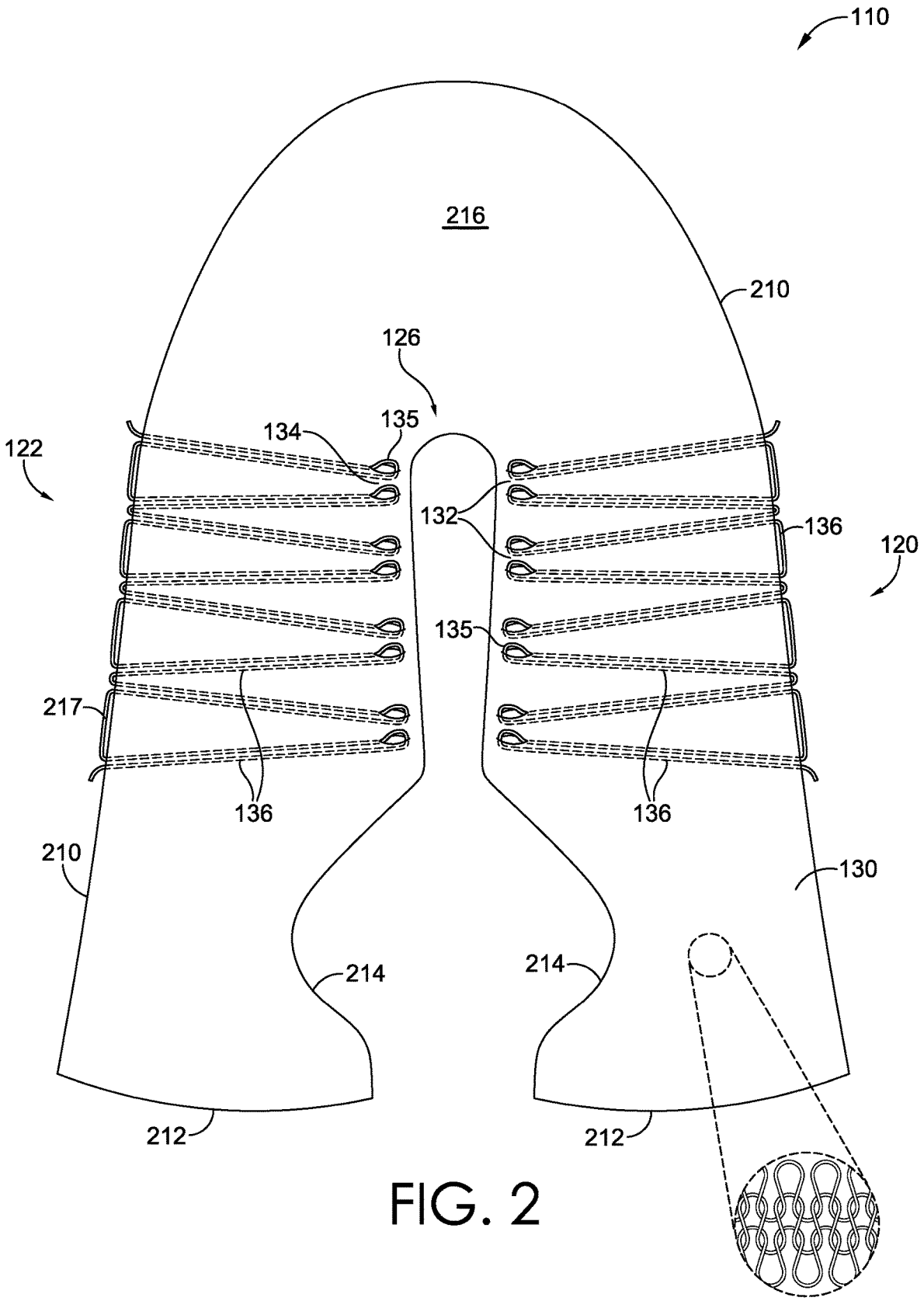
FIG. 2 illustrates an example knit upper with reinforced knit channels in accordance with aspects herein.

FIG. 2 depicts the upper 110 of FIG. 1 before being secured to the sole structure 112 and in a form corresponding to the form that comes off of a knitting machine. The upper 110 is formed from at least one yarn that is manipulated (e.g., with a knitting machine) to form the first knit layer 130 and the second knit layer 132, where each of the first knit layer 130 and the second knit layer 132 includes a plurality of intermeshed loops that define a variety of courses and wales. Aspects herein contemplate that portions of the upper 110 may be joined together (e.g., edges of the upper 110 being joined together) following the knitting process.

The upper 110 has a generally U-shaped configuration that is outlined by a perimeter edge 210, a pair of heel edges 212, and an inner edge 214. When incorporated into an article of footwear such as the article of footwear 100, the perimeter edge 210 may be positioned against the upper surface of a sole structure and may be joined to a strobel in example aspects. In other aspects, the upper 110 may include an underfoot portion. In this example, the article of footwear may not include a strobel. In example aspects, the pair of heel edges 212 are joined to each other and extend generally vertically in a heel region of the article of footwear 100. The inner edge 214 forms the ankle collar 124 and extends forward to define the throat area 126. The upper 110 includes a first surface 216 that corresponds to the exterior surface 111 of the article of footwear 100 and an opposite second surface (not shown) that corresponds to the interior surface 113 of the article of footwear 100.

As shown, the second knit layer 132 is located in discrete areas adjacent each of the medial side 120 and the lateral side 122 of the throat area 126 to form the channel regions 134. Aspects herein contemplate that the second knit layer 132 may be located in additional discrete areas of the upper 110. The number of channel regions 134 depicted in FIGS. 1 and 2 is illustrative, and it is contemplated herein that the upper 110 may include a greater number or a fewer number of channel regions 134. Aspects herein contemplate that the second knit layer 132 may form at least part of the exterior surface 111 of the upper 110, and the first knit layer 130 is positioned interior to the second knit layer 132. Aspects herein contemplate an alternative configuration where the second knit layer 132 may form at least part of the interior surface 113 of the upper 110, with the first knit layer 130 positioned exterior to the second knit layer 132. In this configuration, the portion 135 of the tensile strand 136 that is freely separable may be located interior to the first knit layer 130 of the upper 110. Positioning the second knit layer 132 interior to the first knit layer 130 moves the lacing system away from the exterior side, which would allow a greater amount of area on the exterior surface 111 for adding other components or visualizations without being disrupted by the laces. This configuration may also protect the channel regions 134 from being torn or ripped and protect the tensile strands 136 from being snagged or pulled.

FIG. 2 further depicts the tensile strands 136 including the portion 135 that is freely separable from each of the first knit layer 130 and the second knit layer 132 in the channel regions 134. In one example, and as shown, the tensile strand 136 may comprise a continuous strand on each of the medial side 120 and the lateral side 122 of the upper 110. For example, the tensile strand 136 may include loop portions 217 that extend outward from the perimeter edge 210 and enable the tensile strand 136 to be positioned at different locations in the upper 110. For example, with respect to the lateral side 122, the tensile strand 136 may extend from one of the channel regions 134 toward the perimeter edge 210 where it further extends outside of the knitted component as a loop portion 217 before again integrating back into the knitted component and extending toward a channel region 134 located at a different position along the throat area 126. Although shown as a continuous strand, aspects herein contemplate that the tensile strand 136 may comprise multiple different tensile strands. Any and all aspects, and any variation thereof, are contemplated as being within aspects herein.

Figure 3:
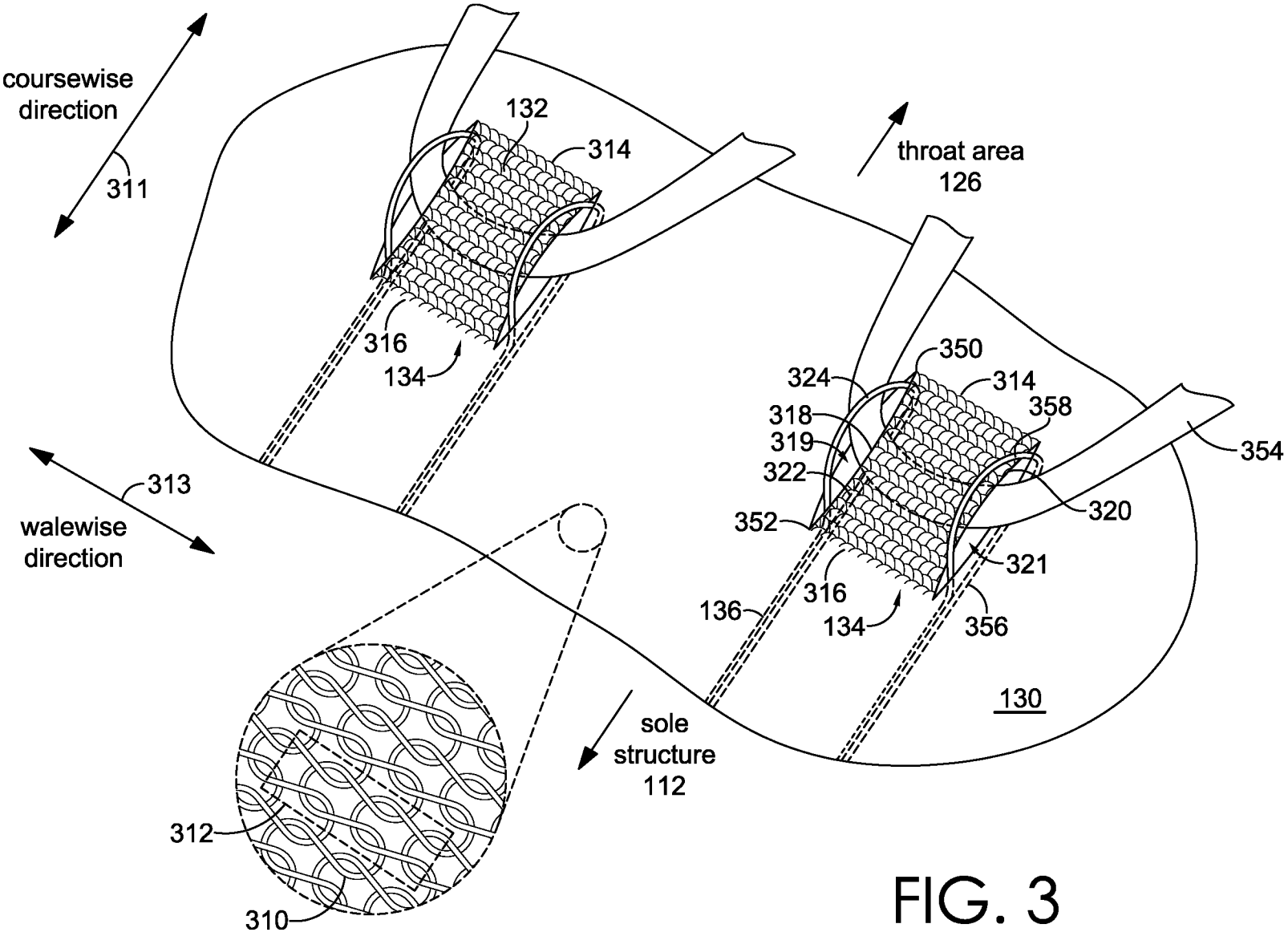
FIG. 3 illustrates a portion of a knit upper having reinforced knit channels and a lace in accordance with aspects herein.

FIG. 3 illustrates a portion of an upper, such as the upper 110, that includes the channel regions 134. The first knit layer 130 is depicted with knit courses 310 extending in a coursewise direction 311 and knit wales 312 (indicated by dashed lines in FIG. 3) extending in a walewise direction 313. In example aspects, the knit courses 310, at least within the portion illustrated in FIG. 3, extend in a direction from the sole structure 112 toward the throat area 126, and the knit wales 312 would extend generally perpendicular to the knit courses 310. In some aspects, the upper 110 is formed from an upper that is radially knit such that all of the knit courses within a unitary knitted component forming the upper extend from the outer perimeter edge 210 to the throat area 126. As such, knit courses forming portions of the upper outside of the portion illustrated in FIG. 3 may not all be parallel to the knit course 310 in FIG. 3. In other aspects, a knitted component forming the upper 110 is formed such that at least a majority of the knit courses extend in a lateral direction across the upper 110, while the knit wales generally extend longitudinally in a direction extending from the forefoot region 114 toward the heel region 118 of the article of footwear 100. Aspects herein contemplate the opposite configuration where the knit courses 310 would generally extend longitudinally from the forefoot region 114 toward the heel region 118, and the knit wales 312 would generally extend from the sole structure 112 toward the throat area 126.

The second knit layer 132 at least partially or completely overlaps the first knit layer 130 in areas where the second knit layer 132 is located. In example aspects, the knit courses that form the second knit layer 132 are aligned in the same direction as the knit courses 310 that form the first knit layer 130 such that the knit courses that form the second knit layer 132 extend in the coursewise direction 311 indicated in FIG. 3. In example aspects, the second knit layer 132 is interlooped with the first knit layer 130 at a first interlooped area 314 and a second interlooped area 316 that is spaced apart from the first interlooped area 314 in a direction toward the sole structure 112. To state this differently, the second knit layer 132 is secured to the first knit layer 130 at the first interlooped area 314 and the second interlooped area 316. In example aspects, the first interlooped area 314 is located closer to the throat area 126 and the second interlooped area 316 is located closer to the sole structure 112. In example aspects, the second knit layer 132 is freely separable from the first knit layer 130 between the first interlooped area 314 and the second interlooped area 316 to form the channel regions 134. As used herein, the term "freely separable" means not connected or affixed to another layer.

In the channel regions 134, the second knit layer 132 comprises a first free edge 318 that forms a first opening 319 of the channel region 134 and a second free edge 320 that forms a second opening 321 of the channel region 134. As used herein, the term "free edge" means an edge that is free from or not connected to an underlying layer, which in this case is the first knit layer 130. Each of the first free edge 318 and the second free edge 320 includes a first end 350 located adjacent to the first interlooped area 314 and a second end 352 located adjacent to the second interlooped area 316 such that each of the first free edge 318 and the second free edge 320 extends between the first interlooped area 314 and the second interlooped area 316. In this way, the channel region 134 extends between the first free edge 318 and the second free edge 320 and has a width in the walewise direction 313, and the channel region 134 further extends between the first interlooped area 314 and the second interlooped area 316 and has a height in the coursewise direction 311. An exterior wall of the channel region 134 is formed by the second knit layer 132, and an interior wall of the channel region 134 is formed by the first knit layer 130.

As described, the tensile strand 136 may help to reinforce the knitted structure around the channel regions 134. In one example construction, the tensile strand 136 may comprise a first portion 322 that is integrated into the first knit layer 130 in the channel region 134. In example aspects, the integration of the first portion 322 into the first knit layer 130 may be through an inlay process or a mock inlay process, further described with respect to FIGS. 5-7. In example aspects, the first portion 322 of the tensile strand 136 may be positioned such that it is interior to and generally parallel with or aligned with the first free edge 318 of the second knit layer 132. In this aspect, the first portion 322 of the tensile strand 136 may help to reinforce the first knit layer 130 at the first opening 319 of the channel region 134.

The tensile strand 136 further includes a second portion 324 that extends over the exterior surface of the first knit layer 130 within the channel region 134. In example aspects, the second portion 324 may be freely separable from the first knit layer 130 and the second knit layer 132. In example aspects, and as further described with respect to FIGS. 4A-4D, the tensile strand 136 transitions from the first portion 322 to the second portion 324 at a border between the first interlooped area 314 and the channel region 134.

In example aspects, the second portion 324 of the tensile strand 136 may be positioned such that it extends adjacent to or parallel with the first free edge 318 of the second knit layer 132. Stated differently, the second portion 324 of the tensile strand 136 may be positioned such that it extends along at least a portion of a length of the first free edge 318 of the second knit layer 132. In further example aspects, the second portion 324 of the tensile strand 136 may be positioned such that it extends along substantially an entirety of the length of the first free edge 318 of the second knit layer 132. In this aspect, the second portion 324 of the tensile strand 136 may help to reinforce the second knit layer 132 at the first opening 319 of the channel region 134.

As depicted, a lace such as lace 354 may be configured to pass through the channel region 134 such that it extends interior to the second knit layer 132 and the second portion 324 of the tensile strand 136 while extending exterior to the first knit layer 130 and the first portion 322 of the tensile strand 136. Thus, the first and second portions 322 and 324 of the tensile strand 136 work together to reinforce the first opening 319 of the channel region 134, which may be useful when the lace 354 is tensioned and exerts forces on the knit structures forming the channel region 134.

The description of the first and second portions 322 and 324 of the tensile strand 136 with respect to the first free edge 318 and the first opening 319 of the channel region 134 may also apply to the second free edge 320 and the second opening 321 of the channel region 134. In example aspects where the tensile strand 136 comprises a continuous strand, the tensile strand 136 may further include a third portion 356 that is integrated into the first knit layer 130 in the channel region 134. In example aspects, the third portion 356 of the tensile strand 136 may be positioned such that it is interior to and generally parallel with or aligned with the second free edge 320 of the second knit layer 132. In this aspect, the third portion 356 of the tensile strand 136 may help to reinforce the first knit layer 130 at the second opening 321 of the channel region 134.

The tensile strand 136 may further include a fourth portion 358 that extends over the exterior surface of the first knit layer 130 within the channel region 134. In example aspects, the fourth portion 358 may be freely separable from the first knit layer 130 and the second knit layer 132. In example aspects, the tensile strand 136 transitions from the third portion 356 to the fourth portion 358 at a border between the first interlooped area 314 and the channel region 134.

In example aspects, the fourth portion 358 of the tensile strand 136 may be positioned such that it extends adjacent to or parallel with the second free edge 320 of the second knit layer 132. Stated differently, the fourth portion 358 of the tensile strand 136 may be positioned such that it extends along at least a portion of a length of the second free edge 320 of the second knit layer 132. In further example aspects, the fourth portion 358 of the tensile strand 136 may be positioned such that it extends along substantially an entirety of the length of the second free edge 320 of the second knit layer 132. In this aspect, the fourth portion 358 of the tensile strand 136 may help to reinforce the second knit layer 132 at the second opening 321 of the channel region 134.

The lace 354 would further extend through the channel region 134 such that it extends interior to the second knit layer 132 and the fourth portion 358 of the tensile strand 136 and exterior to the first knit layer 130 and the third portion 356 of the tensile strand 136. Thus, the first, second, third, and fourth portions 322, 324, 356, and 358 of the tensile strand 136 work together to reinforce the first opening 319 and the second opening 321 of the channel region 134. The description provided above may also be applicable to the different channel regions 134 that extend along the throat area 126 on each of the medial side 120 and the lateral side 122 of the upper 110.

Figure 4B:
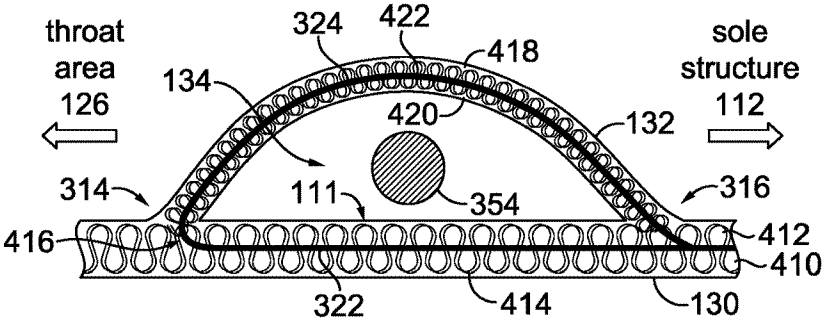
FIG. 4B illustrates a cross-section of a second example construction taken at a location corresponding generally to a first free edge of a reinforced knit channel in accordance with aspects herein.
Figure 4A:
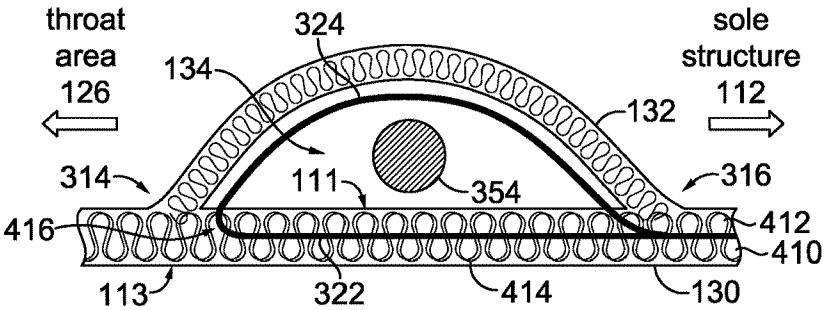
FIG. 4A illustrates a cross-section of a first example construction taken at a location corresponding generally to a first free edge of a reinforced knit channel in accordance with aspects herein.

FIG. 4A depicts a cross-section of a first example construction taken at a location corresponding generally to the first free edge 318 of the second knit layer 132. The first knit layer 130 in FIG. 4A is depicted as having a double knit construction with a first face 410 of loops and a second face 412 of loops. Yarn 414 is depicted as traversing between the first face 410 and the second face 412. In this way, yarn 414 may represent yarn(s) that form both portions of the first face 410 and portions of the second face 412, yarns forming the first face 410 interlooping with yarns forming the second face 412, and/or additional yarn(s) that interloop with yarn (s) in the first face 410 and yarn(s) in the second face 412 to help secure the two faces to each other. The second knit layer 132 is depicted as having a single knit construction. The second knit layer 132 is interlooped with the first knit layer 130 at the first interlooped area 314 and the second interlooped area 316. The second knit layer 132 is freely separable from the first knit layer 130 between the first interlooped area 314 and the second interlooped area 316 to form the channel region 134.

FIG. 4A further depicts the first portion 322 of the tensile strand 136 integrated into the first knit layer 130 in the channel region 134. As described below, this may be through an inlay or a mock inlay process. At a border 416 between the first interlooped area 314 and the channel region 134, the tensile strand 136 transitions from the first portion 322 to the second portion 324. This transition occurs when the tensile strand 136 extends out from the knit structure forming the first knit layer 130. The second portion 324 extends over the exterior surface 111 of the first knit layer 130 within the channel region 134. As shown, the second portion 324 of the tensile strand 136 is freely separable from the first knit layer 130 and the second knit layer 132. The lace 354 is positioned within the channel region 134 such that the lace 354 is between the second portion 324 of the tensile strand 136 and the first knit layer 130. With this configuration, the lace 354 is interior to the second knit layer 132 and the second portion 324 of the tensile strand 136 and is exterior to the first knit layer 130 and the first portion 322 of the tensile strand 136.

FIG. 4B depicts a cross-section of a second example construction taken at a location corresponding generally to the first free edge 318 of the second knit layer 132. Like FIG. 4A, the first knit layer 130 in FIG. 4B is depicted as having a double knit construction with the first face 410 of loops and the second face 412 of loops. The yarn 414 is depicted as traversing between the first face 410 and the second face 412 and may represent similar configurations described with respect to FIG. 4A.

Unlike FIG. 4A, in FIG. 4B the second knit layer 132 is depicted as also having a double knit construction with a first face 418 of loops and a second face 420 of loops. A yarn 422 is depicted as traversing between the first face 418 and the second face 420. In this way, yarn 422 may represent yarn(s) that form both portions of the first face 418 and portions of the second face 420, yarns forming the first face 418 interlooping with yarns forming the second face 420, and/or additional yarn(s) that may interloop with yarn(s) in the first face 418 and yarn(s) in the second face 420 to help secure the two faces to each other. The second knit layer 132 is interlooped with the first knit layer 130 at the first interlooped area 314 and the second interlooped area 316. The second knit layer 132 is freely separable from the first knit layer 130 between the first interlooped area 314 and the second interlooped area 316 to form the channel region 134.

FIG. 4B further depicts the first portion 322 of the tensile strand 136 integrated into the first knit layer 130 in the channel region 134. As described below, this may be through an inlay or a mock inlay process. At the border 416 between the first interlooped area 314 and the channel region 134, the tensile strand 136 transitions from the first portion 322 to the second portion 324. However, unlike the construction shown in FIG. 4A, in this construction, the second portion 324 is also integrated into the second knit layer 132 in the channel region 134 using an inlay or a mock inlay process. In this example, the second portion 324 of the tensile strand 136 is not freely separable from the first knit layer 130 and the second knit layer 132. The lace 354 is positioned within the channel region 134 such that the lace 354 is positioned between the first knit layer 130 and the second knit layer 132. In this way, the lace 354 is interior to the second knit layer 132 and the second portion 324 of the tensile strand 136 and is exterior to the first knit layer 130 and the first portion 322 of the tensile strand 136. The integration of the first and second portions 322 and 324 of the tensile strand 136 into the first knit layer 130 and the second knit layer 132, respectively, also functions to reinforce the openings of the channel region 134.

Figure 4D:
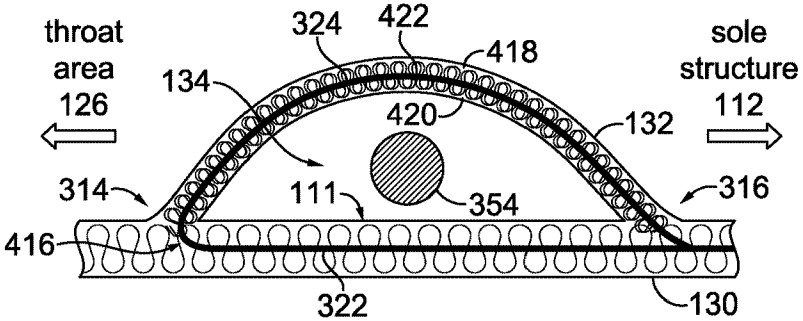
FIG. 4D illustrates a cross-section of a fourth example construction taken at a location corresponding generally to a first free edge of a reinforced knit channel in accordance with aspects herein.
Figure 4C:
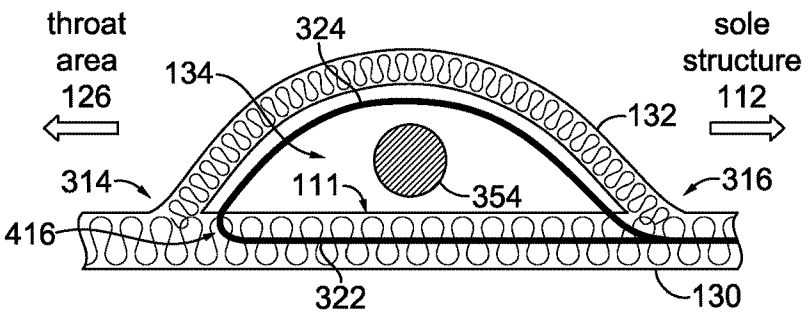
FIG. 4C illustrates a cross-section of a third example construction taken at a location corresponding generally to a first free edge of a reinforced knit channel in accordance with aspects herein.

FIG. 4C depicts a cross-section of a third example construction taken at a location corresponding generally to the first free edge 318 of the second knit layer 132. Unlike FIGS. 4A and 4B, the first knit layer 130 is depicted as having a single knit construction. The second knit layer 132 is interlooped with the first knit layer 130 at the first interlooped area 314 and the second interlooped area 316. The second knit layer 132 is freely separable from the first knit layer 130 between the first interlooped area 314 and the second interlooped area 316 to form the channel region 134.

FIG. 4C further depicts the first portion 322 of the tensile strand 136 integrated into the first knit layer 130 in the channel region 134. As described below, this may be through an inlay or a mock inlay process. At the border 416 between the first interlooped area 314 and the channel region 134, the tensile strand 136 transitions from the first portion 322 to the second portion 324. The second portion 324 of the tensile strand 136 extends over the exterior surface 111 of the first knit layer 130 within the channel region 134. As shown, the second portion 324 of the tensile strand 136 is freely separable from the first knit layer 130 and the second knit layer 132. The lace 354 is positioned within the channel region 134 such that the lace 354 is between the second portion 324 of the tensile strand 136 and the first knit layer 130. The lace 354 is positioned interior to the second knit layer 132 and the second portion 324 of the tensile strand 136 and is exterior to the first knit layer 130 and the first portion 322 of the tensile strand 136.

FIG. 4D depicts a cross-section of a fourth example construction taken at a location corresponding generally to the first free edge 318 of the second knit layer 132. The first knit layer 130 is depicted as having a single knit construction. The second knit layer 132 is depicted as having a double knit construction with the first face 418 of loops and the second face 420 of loops. The yarn 422 is depicted as traversing between the first face 418 and the second face 420 and may represent similar configurations described with respect to FIG. 4B. The second knit layer 132 is interlooped with the first knit layer 130 at the first interlooped area 314 and the second interlooped area 316. The second knit layer 132 is freely separable from the first knit layer 130 between the first interlooped area 314 and the second interlooped area 316 to form the channel region 134.

FIG. 4D further depicts the first portion 322 of the tensile strand 136 integrated into the first knit layer 130 in the channel region 134. As described below, this may be through an inlay or a mock inlay process. At the border 416 between the first interlooped area 314 and the channel region 134, the tensile strand 136 transitions from the first portion 322 to the second portion 324. The second portion 324 is integrated into the second knit layer 132 in the channel region 134 using an inlay or a mock inlay process. In this example, the second portion 324 of the tensile strand 136 is not freely separable from the first knit layer 130 and the second knit layer 132. The lace 354 is positioned within the channel region 134 such that the lace 354 is between the first knit layer 130 and the second knit layer 132. The lace 354 is positioned interior to the second knit layer 132 and the second portion 324 of the tensile strand 136 and is exterior to the first knit layer 130 and the first portion 322 of the tensile strand 136.

The different constructions depicted in FIGS. 4A-4D are illustrative examples, and additional constructions are contemplated herein. For example, aspects herein contemplate that the second portion 324 of the tensile strand 136 may not be integrated into the second knit layer 132 and remain freely separate from the first and second knit layers 130 and 132 as described with respect to FIGS. 4A and 4C while the second knit layer 132 comprises a double knit construction as described with respect to FIGS. 4B and 4D. Any and all aspects, and any variation thereof, are contemplated as being within the scope herein.

Figure 5:
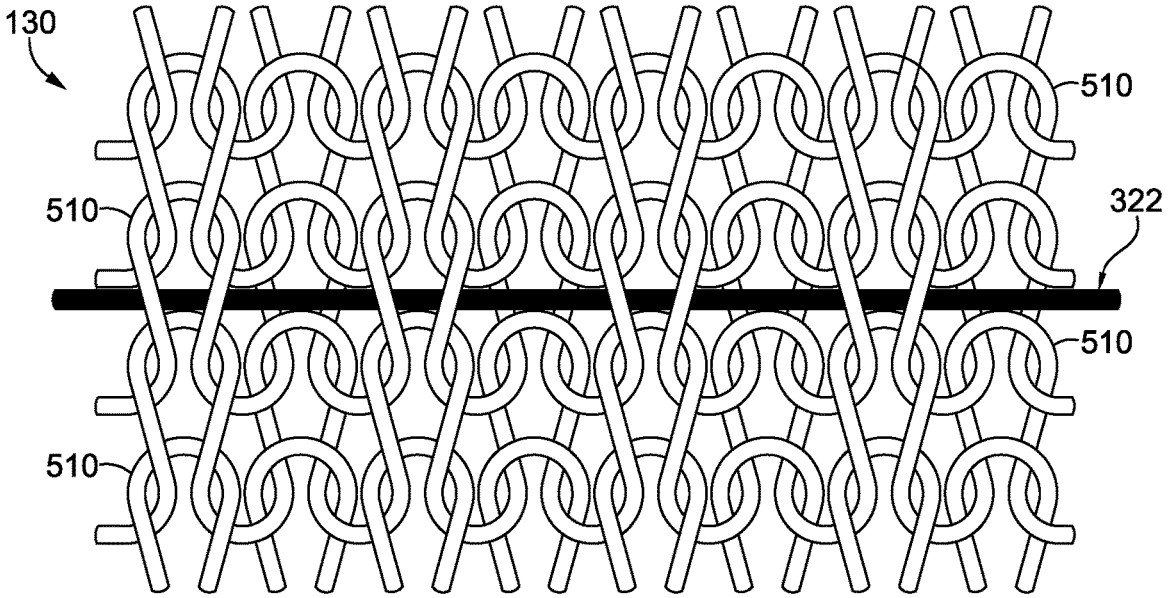
FIG. 5 illustrates a plan view of a single knit construction having an inlaid tensile strand in accordance with aspects herein.

FIG. 5 depicts a knit schematic illustrating how the first portion 322 of the tensile strand 136 may be integrated into the first knit layer 130 when the first knit layer 130 comprises a single knit construction, such as the constructions depicted in FIGS. 4C and 4D. FIG. 5 would further depict how the second portion 324 of the tensile strand 136 may be integrated into the second knit layer 132 when the second knit layer 132 comprises a single knit construction, such as the constructions depicted in FIG. 4A. The first knit layer 130 includes a yarn 510 that forms a plurality of intermeshed loops defining multiple horizontal courses and vertical wales. The first portion 322 of the tensile strand 136 extends along one of the courses and alternates between being located (a) behind loops formed from the yarn 510 and (b) in front of loops formed from the yarn 510. In effect, the first portion 322 of the tensile strand 136 weaves through the structure formed by first knit layer 130. Although the yarn 510 forms each of the courses in this configuration, additional yarns may form one or more of the courses or may form a portion of one or more of the courses. Although the tensile strand 136 is shown extending along knit courses, aspects herein contemplate that the tensile strand 136 may extend along knit wales in a similar manner.

Figure 6:
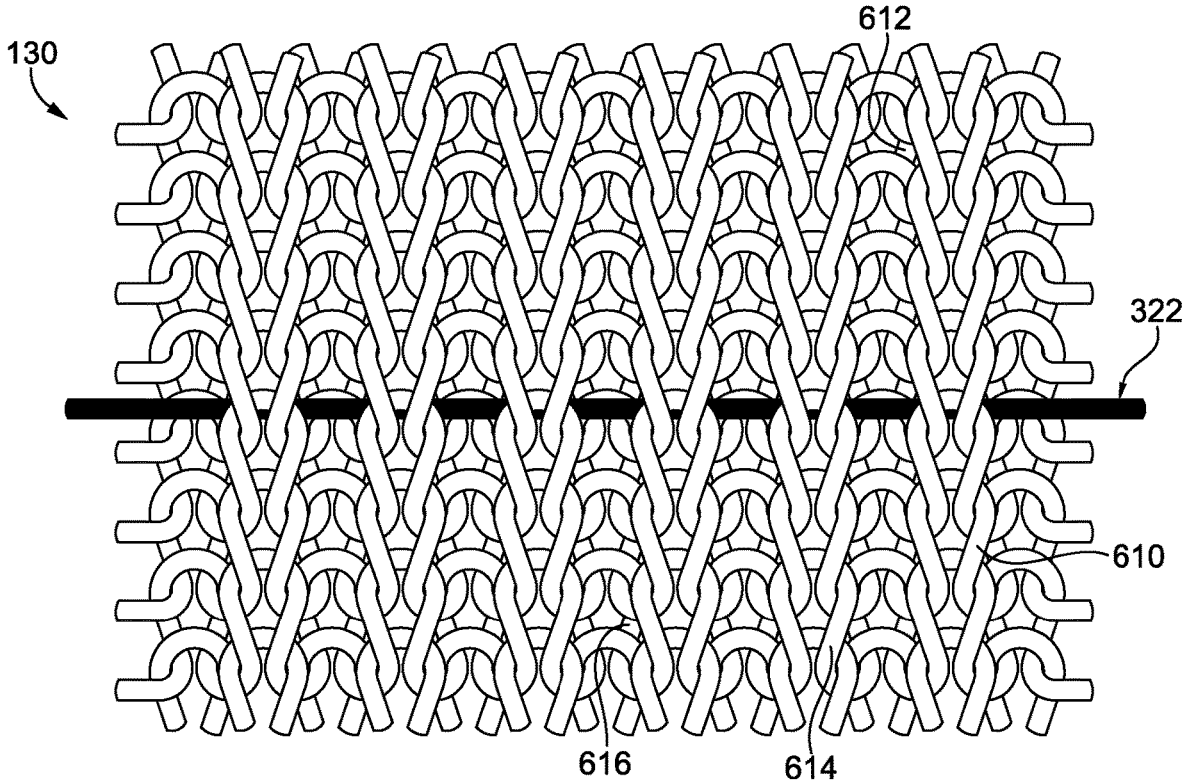
FIG. 6 illustrates a plan view of a double knit construction having an inlaid tensile strand in accordance with aspects herein.

FIG. 6 depicts a knit schematic illustrating how the first portion 322 of the tensile strand 136 may be integrated into the first knit layer 130 when the first knit layer 130 comprises a double knit construction. FIG. 6 would further depict how the second portion 324 of the tensile strand 136 may be integrated into the second knit layer 132 when the second knit layer 132 comprises a double knit construction. In this configuration, the first knit layer 130 includes yarn 610 and another yarn 612. The yarns 610 and 612 may be knit on opposing beds of a multi-bed knitting machine and cooperatively form a first face 614 and an opposing second face 616 of the first knit layer 130, where each of the first face 614 and the second face 616 comprise a plurality of intermeshed loops defining multiple horizontal courses and vertical wales. The first portion 322 of the tensile strand 136 extends along one of the courses and alternates between being located (a) behind loops formed from the yarns 610 and 612 and (b) in front of loops formed from the yarns 610 and 612. Although the tensile strand 136 is shown extending along knit courses, aspects herein contemplate that the tensile strand 136 may extend along knit wales.

Figure 7:
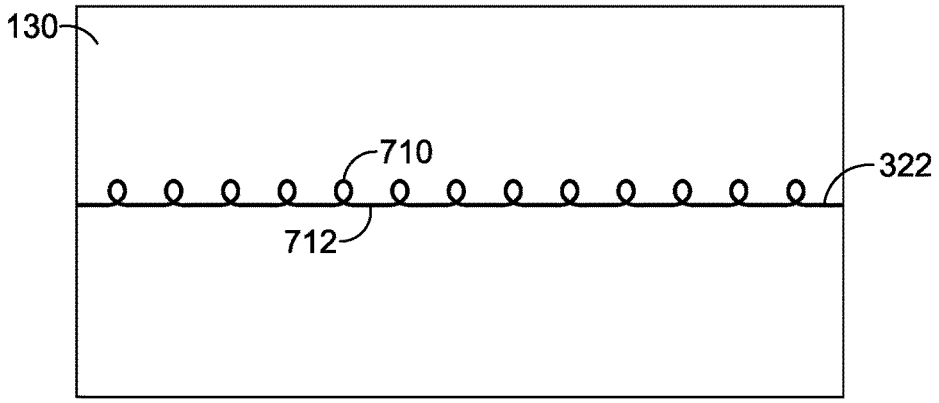
FIG. 7 illustrates a schematic of a mock inlay knit structure in accordance with aspects herein.

FIG. 7 depicts a schematic of a portion of the first knit layer 130 with a mock or simulated inlay structure. The same description may also apply to the second knit layer 132. Particularly, the first portion 322 of the tensile strand 136 includes a sequence of knit stitches 710 (e.g., knit loops) and float stitches 712, where the sequence is repeated along the length of the first portion 322. In example aspects, the sequence includes one knit stitch 710 and a float stitch 712 extending across a plurality of wales. The number of wales that the float stitch 712 extends across may correspond to the number of needles along a needle bed that the first portion 322 of the tensile strand 136 is floated in between two knit stitches. The number of wales that each float stitch 712 extends across may be within a range 3 to 8, within a range of 4 to 7, and within a range of 5 to 6. In one example, each float stitch 712 of the first portion 322 of the tensile strand 136 extends across 5 wales. As such, the first portion 322 of the tensile strand 136 may be knit using a knit sequence of one knit stitch formed on one needle and one float stitch extending across five needles.

The incorporation of the float stitches 712 may help to simulate strength and stretch resistance imparted when inlaying the first portion 322 of the tensile strand 136 into the first knit layer 130. However, knitting the first portion 322 of the tensile strand 136 with occasional knit stitches (loops) 710 may help to keep the first portion 322 aligned along the knit course. Further, the incorporation of the first portion 322 of the tensile strand 136 with knit stitches 710 and float stitches 712 may create more flexibility with the knitting process because incorporating the first portion 322 in this manner may be performed with a combination feeder or with a regular feeder on a knitting machine, while inlaying is typically only performed with a combination feeder.

Figure 8:
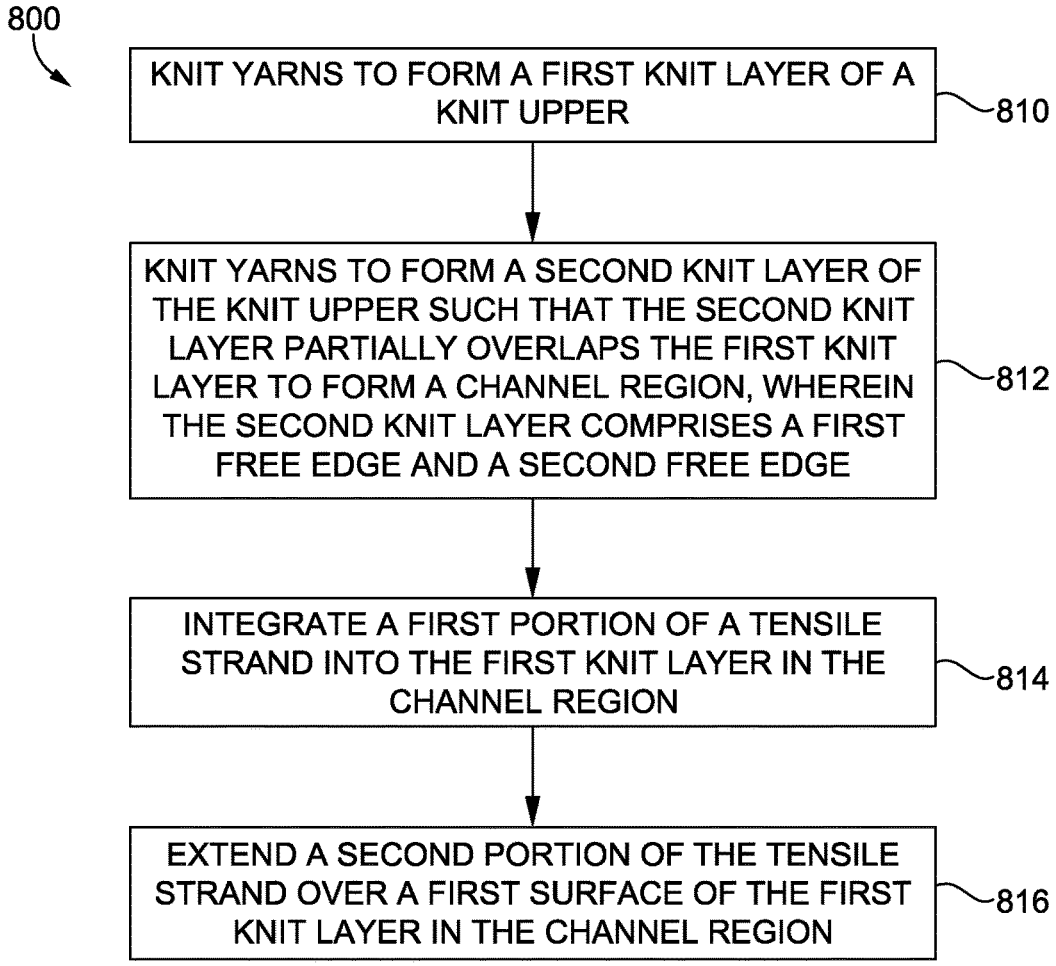
FIG. 8 illustrates an example flow diagram of a method for forming an upper having a reinforced knit channel in accordance with aspects herein.

FIG. 8 depicts a flow diagram of an example method 800 of manufacturing a knit upper, such as the upper 110, for an article of footwear, such as the article of footwear 100. At a step 810, one or more yarns are knit to form a first knit layer of the upper, such as the first knit layer 130. In example aspects, the first knit layer may be knit to have a single knit construction or a double knit construction.

At a step 812, one or more yarns are knit to form a second knit layer of the upper, such as the second knit layer 132. The second knit layer may be knit to have a single knit construction or a double knit construction. The second knit layer at least partially overlaps the first knit layer at one or more discrete areas of the upper. In example aspects, the second knit layer is interlooped with the first knit layer at a first interlooped area, such as the first interlooped area 314 and a second interlooped area, such as the second interlooped area 316. The second knit layer is freely separable from the first knit layer and the second knit layer between the first interlooped area and the second interlooped area to form a channel region, such as the channel region 134. The second knit layer includes a first free edge, such as the first free edge 318 that forms a first opening to the channel region, such as the first opening 319. The second knit layer further includes a second free edge, such as the second free edge 320 that forms a second opening of the channel region, such as the second opening 321.

At a step 814, a first portion of a tensile strand, such as the first portion 322 of the tensile strand 136, is integrated into the first knit layer in the channel region using, for example, an inlay process or a mock inlay process. At a step 816, a second portion of a tensile strand, such as the second portion 324 of the tensile strand 136, is extended over a first surface of the first knit layer in the channel region. In some example aspects where the second portion of the tensile strand is not integrated into the second knit layer, the second portion of the tensile strand is freely separable from the first knit layer and the second knit layer. The upper may be incorporated into the article of footwear, and a lace, such as the lace 354, may be threaded through the channel region. In this aspect, the lace may be positioned between the first knit layer and the second knit layer and between the first portion and the second portion of the tensile strand. In this aspect, the tensile strand helps to reinforce the openings of the channel region, which may increase the useable life of the article of footwear.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A reinforced knit channel for an upper for an article of footwear, the reinforced knit channel comprising: a first knit layer; a second knit layer at least partially overlapping the first knit layer and interlooped with the first knit layer at a first interlooped area and a second interlooped area, the second knit layer being freely separable from the first knit layer between the first interlooped area and the second interlooped area to form a channel region, wherein the second knit layer comprises a first free edge forming a first opening of the channel region and a second free edge forming a second opening of the channel region such that the channel region extends between the first opening and the second opening; and a tensile strand comprising a first portion integrated into the first knit layer in the channel region and a second portion extending over a surface of the first knit layer within the channel region and freely separable from the first knit layer and the second knit layer.

Clause 2. The reinforced knit channel for the upper for the article of footwear according to clause 1, wherein the second portion of the tensile strand extends along at least a portion of a length of the first free edge.

Clause 3. The reinforced knit channel for the upper for the article of footwear according to any of clauses 1 through 2, wherein the first interlooped area is located adjacent a first end of the first free edge of the second knit layer, and wherein the second interlooped area is located adjacent a second end of the first free edge of the second knit layer such that the first free edge of the second knit layer extends between the first interlooped area and the second interlooped area.

Clause 4. The reinforced knit channel for the upper for the article of footwear according to any of clauses 1 through 3, wherein the first knit layer is a double knit construction and the first portion of the tensile strand is inlaid between knit loops of the double knit construction of the first knit layer.

Clause 5. The reinforced knit channel for the upper for the article of footwear according to clause 1 through 4, wherein the second knit layer is a single knit construction.

Clause 6. The reinforced knit channel for the upper for the article of footwear according to any of clauses 1 through 5, wherein the first knit layer is interior to the second knit layer.

Clause 7. The reinforced knit channel for the upper for the article of footwear according to any of clauses 1 through 6, wherein the second knit layer forms at least part of an exterior surface of the upper.

Clause 8. The reinforced knit channel for the upper for the article of footwear according to any of clauses 1 through 7, wherein the second portion of the tensile strand is located exterior to the first portion of the tensile strand.

Clause 9. An article of footwear comprising: an upper, the upper comprising: a first knit layer forming at least a portion of the upper; a second knit layer at least partially overlapping the first knit layer, the second knit layer interlooped with the first knit layer at a first interlooped area and a second interlooped area, the second knit layer being freely separable from the first knit layer between the first interlooped area and the second interlooped area to form a channel region, wherein the second knit layer comprises a first free edge forming a first opening of the channel region and a second free edge forming a second opening of the channel region such that the channel region extends between the first opening and the second opening; and a tensile strand comprising a portion that is integrated into one of the first knit layer in the channel region and the second knit layer in the channel region.

Clause 10. The article of footwear according to clause 9, wherein the portion of the tensile strand is inlaid into the first knit layer in the channel region.

Clause 11. The article of footwear according to clause 10, wherein the portion of the tensile strand inlaid into the first knit layer is a first portion, wherein the tensile strand further comprises a second portion that is inlaid into the second knit layer in the channel region.

Clause 12. The article of footwear according to clause 11, wherein the first knit layer is a double knit construction, and the first portion of the tensile strand is inlaid between knit loops of the double knit construction of the first knit layer.

Clause 13. The article of footwear according to clause 9, wherein the portion of the tensile strand is inlaid into the second knit layer in the channel region.

Clause 14. The article of footwear according to clause 10, wherein the portion of the tensile strand inlaid into the first knit layer is a first portion, wherein the tensile strand further comprises a second portion extending above the second knit layer and freely separable from the first knit layer and the second knit layer.

Clause 15. The article of footwear according to clause 14, wherein the tensile strand transitions from the first portion to the second portion at a border between the first interlooped area and the channel region.

Clause 16. The article of footwear according to clause 14, further comprising a lace extending between the second portion of the tensile strand and a part of the first knit layer in which the first portion of the tensile strand is integrated.

Clause 17. The article of footwear according to clause 9, wherein the first knit layer is interior to the second knit layer.

Clause 18. The article of footwear according to clause 9, wherein the second knit layer forms at least part of an exterior surface of the upper.

Clause 19. The article of footwear according to clause 9, wherein the tensile strand has a greater resistance to stretch than yarns in one or more of the first knit layer and the second knit layer.

Clause 20. The article of footwear of clause 9, wherein the tensile strand extends in a coursewise direction and the channel extends between the first free edge and the second free edge in a walewise direction.

Clause 21. The article of footwear of clause 20, wherein the coursewise direction extends from a sole structure toward a throat area of the upper.

Clause 22. A method of manufacturing a knit upper for an article of footwear, the method comprising: knitting one or more yarns to form a first knit layer of the knit upper; knitting the one or more yarns to form a second knit layer of the knit upper, the second knit layer at least partially overlapping the first knit layer, the second knit layer interlooped with the first knit layer at a first interlooped area and a second interlooped area, the second knit layer being freely separable from the first knit layer between the first interlooped area and the second interlooped area to form a channel region, wherein the second knit layer comprises a first free edge forming a first opening of the channel region and a second free edge forming a second opening of the channel region such that the channel region extends between the first opening and the second opening; integrating a first portion of a tensile strand into the first knit layer in the channel region; and extending a second portion of the tensile strand over a first surface of the first knit layer within the channel region, the second portion of the tensile strand freely separable from the first knit layer and the second knit layer.

Clause 23. An article of footwear, the article of footwear comprising: an upper, the upper comprising: a first knit layer forming at least a throat area of the upper; a second knit layer at least partially overlapping the first knit layer in the throat area of the upper, the second knit layer interlooped with the first knit layer at a first interlooped area and a second interlooped area, the second knit layer being freely separable from the first knit layer between the first interlooped area and the second interlooped area to form a channel region, wherein the second knit layer comprises a first free edge forming a first opening of the channel region and a second free edge forming a second opening of the channel region such that the channel region extends between the first opening and the second opening; and a tensile strand comprising a first portion integrated into the first knit layer in the channel region and a second portion extending over a surface of the first knit layer within the channel region and freely separable from the first knit layer and the second knit layer.

Clause 24. The article of footwear according to clause 21, wherein the second portion of the tensile strand is located exterior to the first portion of the tensile strand.

Clause 25. The article of footwear according to any of clauses 21 through 22, further comprising a lace extending between the second portion of the tensile strand and a part of the first knit layer in which the first portion of the tensile strand is integrated.

Clause 26. The article of footwear according to any of clauses 21 through 23, wherein the tensile strand has a greater resistance to stretch than yarns in one or more of the first knit layer and the second knit layer.

Clause 27. The article of footwear according to any of clauses 21 through 24, wherein the tensile strand transitions from the first portion to the second portion at a border between the first interlooped area and the channel region.

Clause 28. The article of footwear according to any of clauses 21 through 25, wherein the first knit layer is a double knit construction.

Clause 29. The article of footwear according to clause 26, wherein the first portion of the tensile strand is inlaid between knit loops of the double knit construction of the first knit layer.

Clause 30. The article of footwear according to any of clauses 21 through 27, wherein the first knit layer forms at least part of an interior surface of the upper.

Clause 31. The article of footwear according to any of clauses 21 through 28, wherein the second knit layer forms at least part of an exterior surface of the upper.

Clause 32: The article of footwear of any of clauses 21 through 29, wherein the upper is radially knit such that a plurality of knit courses within a unitary knitted component forming the upper extend from an outer perimeter edge to a throat area.

What is claimed is:

1. A reinforced knit channel for an upper for an article of footwear, the reinforced knit channel comprising:

a first knit layer;

a second knit layer at least partially overlapping the first knit layer and interlooped with the first knit layer at a first interlooped area and a second interlooped area, the second knit layer being freely separable from the first knit layer between the first interlooped area and the second interlooped area to form a channel region, wherein the second knit layer comprises a first free edge forming a first opening of the channel region and a second free edge forming a second opening of the channel region such that the channel region extends between the first opening and the second opening; and a tensile strand comprising a first portion integrated into the first knit layer in the channel region and a second portion extending over a surface of the first knit layer within the channel region and freely separable from the first knit layer and the second knit layer.

2. The reinforced knit channel for the upper for the article of footwear of claim 1, wherein the second portion of the tensile strand extends along at least a portion of a length of the first free edge.

3. The reinforced knit channel for the upper for the article of footwear of claim 1, wherein the first interlooped area is located adjacent a first end of the first free edge of the second knit layer, and wherein the second interlooped area is located adjacent a second end of the first free edge of the second knit layer such that the first free edge of the second knit layer extends between the first interlooped area and the second interlooped area.

4. The reinforced knit channel for the upper for the article of footwear of claim 1, wherein the first knit layer is a double knit construction and the first portion of the tensile strand is inlaid between knit loops of the double knit construction of the first knit layer.

5. The reinforced knit channel for the upper for the article of footwear of claim 1, wherein the second knit layer is a single knit construction.

6. The reinforced knit channel for the upper for the article of footwear of claim 1, wherein the first knit layer is interior to the second knit layer.

7. The reinforced knit channel for the upper for the article of footwear of claim 1, wherein the second knit layer forms at least part of an exterior surface of the upper.

8. The reinforced knit channel for the upper for the article of footwear of claim 1, wherein the second portion of the tensile strand is located exterior to the first portion of the tensile strand.

9. An article of footwear, comprising:

an upper, comprising:

a first knit layer forming at least a portion of the upper;

a second knit layer at least partially overlapping the first knit layer, the second knit layer interlooped with the first knit layer at a first interlooped area and at a second interlooped area, the second knit layer being freely separable from the first knit layer between the first interlooped area and the second interlooped area to form a channel region, wherein the second knit layer comprises a first free edge forming a first opening of the channel region and a second free edge forming a second opening of the channel region such that the channel region extends between the first opening and the second opening; and a tensile strand comprising a portion that is integrated into the first knit layer in the channel region and a portion that is spaced from the first knit layer within the channel region.

10. The article of footwear of claim 9, wherein the portion of the tensile strand is inlaid into the first knit layer in the channel region.

11. The article of footwear of claim 10, wherein the portion of the tensile strand inlaid into the first knit layer is a first portion, wherein the tensile strand further comprises a second portion that is inlaid into the second knit layer in the channel region.

12. The article of footwear of claim 9, wherein the first knit layer is a double knit construction, and the portion of the tensile strand that is integrated into the first knit layer in the channel region is inlaid between knit loops of the double knit construction of the first knit layer.

13. The article of footwear of claim 9, wherein the portion of the tensile strand is inlaid into the second knit layer in the channel region.

14. The article of footwear of claim 10, wherein the portion of the tensile strand inlaid into the first knit layer is a first portion, wherein the tensile strand further comprises a second portion extending above the second knit layer and freely separable from the first knit layer and the second knit layer.

15. The article of footwear of claim 14, wherein the tensile strand transitions from the first portion to the second portion at a border between the first interlooped area and the channel region.

16. The article of footwear of claim 14, further comprising a lace extending between the second portion of the tensile strand and a part of the first knit layer in which the first portion of the tensile strand is integrated.

17. The article of footwear of claim 9, wherein the upper is radially knit such that a plurality of knit courses within a unitary knitted component forming the upper extend from an outer perimeter edge to a throat area.

18. The article of footwear of claim 9, wherein the second knit layer forms at least part of an exterior surface of the upper.

19. The article of footwear of claim 9, wherein the tensile strand has a greater resistance to stretch than yarns in one or more of the first knit layer and the second knit layer.

20. The article of footwear of claim 9, wherein the tensile strand extends in a coursewise direction and the channel region extends between the first free edge and the second free edge in a walewise direction.

21. The article of footwear of claim 20, wherein the coursewise direction extends from a sole structure toward a throat area of the upper.

* * * * *